US005742609A

United States Patent [19]

Kondrak et al.

[11] Patent Number: 5,742,609

[45] Date of Patent: Apr. 21, 1998

[54] SMART CANISTER SYSTEMS

[76] Inventors: Mark R. Kondrak, 5200 63rd Ave. North, Brooklyn Center, Minn. 55429; Pradip C. Kar, 12074 Unity St. NW., Coon Rapids, Minn. 55448; Ronald E. Hannig, 11480 Foley Blvd. NW., Coon Rapids, Minn. 55433; Charles H. Hoke, Jr., WRAIR, DVD, Dept. of Virus Diseases, Wash, D.C. 20307

[21] Appl. No.: 389,854

[22] Filed: Feb. 17, 1995

Related U.S. Application Data

[63] Continuation of Ser. No. 84,690, Jun. 29, 1993, abandoned.

[51] Int. Cl.[6] ..... H04J 3/16

[52] U.S. Cl. ..... 370/465; 244/3.16

[58] Field of Search ..... 370/85.1, 85.13, 370/85.14, 85.15, 85.12, 16, 451, 465, 466, 467; 340/825.5, 825.05, 825.07, 870.16, 870.17, 827; 342/60, 61, 62, 64; 89/1.811, 1.812, 1.813, 1.807, 1.801, 1.816, 1.805, 1.81; 244/3.1, 3.12, 3.16, 3.17, 3.21, 3.24, 3.27, 329; 364/148

[56] References Cited

U.S. PATENT DOCUMENTS 4,602,552 7/1986 Steinmetz, Jr. ..... 89/1.816

*Primary Examiner*—Dang Ton

*Attorney, Agent, or Firm*—Ronald C. Kamp

[57] ABSTRACT

The smart canister systems disclosed herein enables missile population to increase while minimizing the need for additional interface hardware. Particularly, multiplexing and demultiplexing functions and conversion flexibility enable the system to be adaptable to different types of missile characteristics and hardware. A redundant, bi-directional bus architecture with a distributed and dynamically reconfigurable control as well as enhanced built-in-test, fault monitoring and display capability enable the smart canister systems to provide a faster response time and higher launcher availability in a multifarious missile environment.

8 Claims, 8 Drawing Sheets

SMART CANISTER SYSTEMS

This is a continuation of application Ser. No. 08/084,690 filed Jun. 29, 1993 now abandoned; hereinafter the parent. Consistent with 37 C.F.R. § 1.60 the parent application is abandoned and replaced by this Continuation Application.

FIELD OF THE INVENTION

This invention relates to Smart Canister Systems which comprise a canister-to-launcher interface architecture for missile launching operations. The interface architecture includes multiplexed power, control, and safety related signals including redundant bi-directional Local Area Networks (LAN) which dynamically provide expandability and adaptability to a variety of missiles and launching systems as well as to changing mission requirements and objectives.

SUMMARY OF THE INVENTION

The Smart Canister System disclosed herein relates to a control architecture having an adaptable, flexible and highly standardized interface system which is compatible with both present and future weapon systems and requirements. The present invention includes electronics systems which perform analog and or digital signal multiplexing and or demultiplexing functions, and collection and transmission of canister status and sensor information dynamically. Heretofore, such control systems are static and do not lend themselves to re-configuration without a major system overhaul or redesign.

The Smart Canister Systems electronics comprises a self monitoring built-in-test feature which provides readiness and availability assessment to the system. Further, a distributed control and redundant Bus architecture are utilized to increase system availability. Specifically, the redundancy of the Bus architecture provides dynamic reconfiguration capabilities which enables the creation of a fault tolerant system.

More significantly, the Smart Canister System enables simplification of electrical interface components required for integrating new encanistered ordnance into weapon system launchers. Further, the present invention implements standard interfaces to promote the interoperability, adaptability and interchangeability of encanistered ordnance among a broad spectrum of users such as the US Military Services, NATO and other allied nations.

DESCRIPTION OF THE PREFERRED EMBODIMENT

The Smart Canister Systems of the present invention enables flexibility and interchangeability of missile systems while minimizing the need for additional interface hardware. Specifically, the multiplexing and demultiplexing features of the control system architecture enable adaptability and ease to incorporate new missiles and to accommodate changing mission requirements and objectives. More specifically, the present invention enables present and future weapon delivery systems to control, monitor and launch missiles from multi-missile canisters. The system of the present invention provides a control architecture which supports multiple, sequential, stages of weapon preparation such as reversible and irreversible phases of preparation as they apply to missile launching missions. A reversible phase of preparation includes the ability to abort and or interrupt missile preparation under impending launch scenarios without incurring the loss of that missile or asset. Conversely, if the launch preparation is aborted or interrupted beyond an acceptable limit during the irreversible phase, the missile or asset will be dudded. Further, the Smart Canister Systems provides compatibility with existing vertical launch systems. The standardized interface of the present invention enables ease of integration of new missiles and canisters thus reducing cost and upgrade time for most launch systems. Moreover the trend in requirements imposed on most modern weapon delivery systems is to reduce weapon system reaction time. Accordingly the present invention is capable of meeting those more stringent reaction time requirements by providing a high speed, bi-directional, interface for all functions including availability and launch sequence status reporting. The timely reporting of this information minimizes delays and allows the system to optimize the use of assets to meet the reaction time requirements. Some of the significant features of the present invention include redundant, bi-directional Bus architecture as well as dynamically reconfigurable control systems. As will be discussed hereinbelow, these and other features enable the present invention to have a measurable advantage over the prior art.

Figure 1:
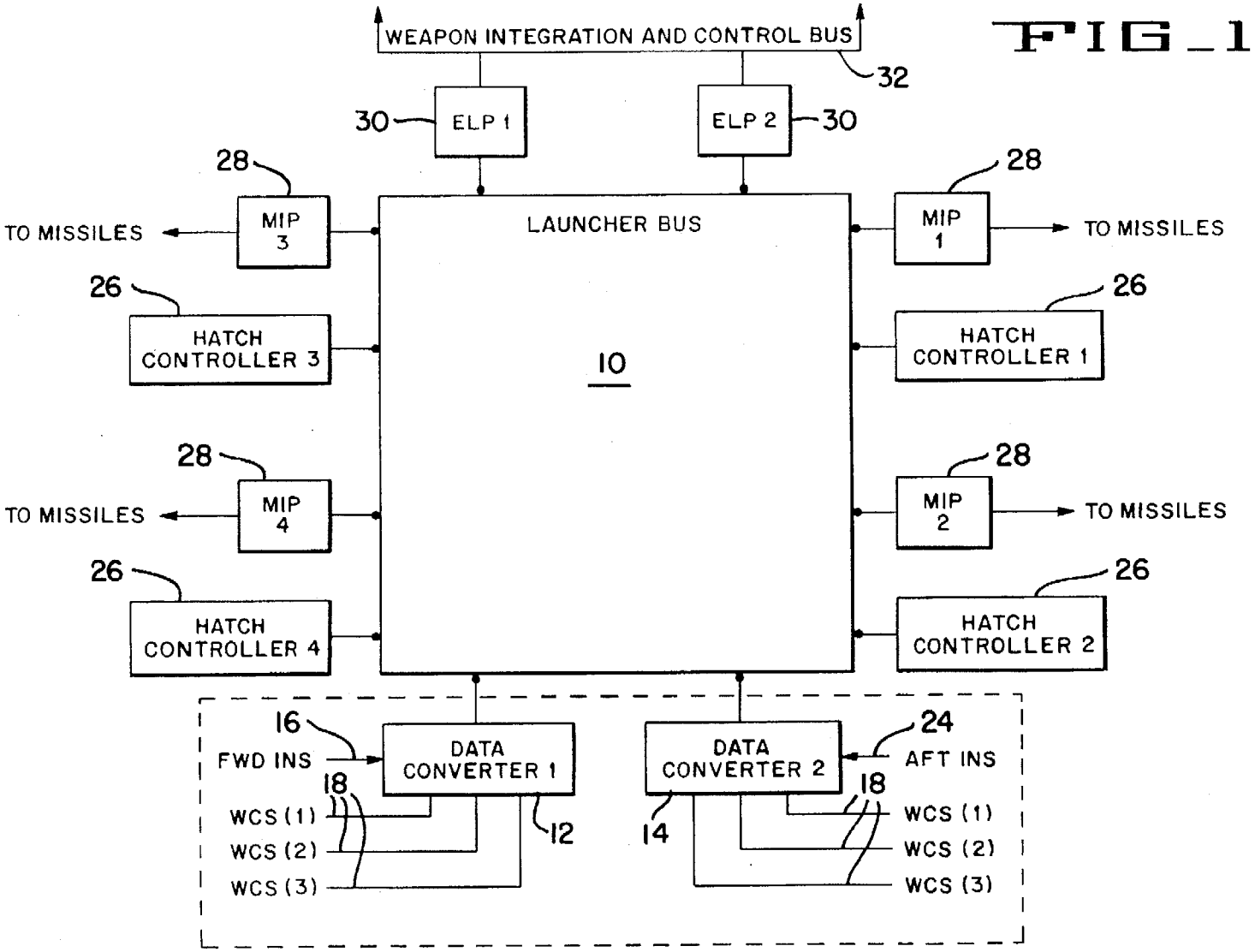
FIG. 1 is a missile launch control system block diagram showing the different types of processors and associated control components.

An embodiment of the present invention is shown in FIG. 1. Launcher Bus 10 shows a communication network where components are joined together by a Data Bus. Accordingly, Data Converters 12 and 14 are hooked to Launcher Bus 10. Forward Inertial Navigations System (FWD INS) 16 and Weapon Control Systems (WCS) 18 are also connected to Data Converter 12. Similarly, an Aft Inertial Navigation System (AFT INS) 24 is linked to Data Converter 14. Launcher Bus 10 is also connected to Hatch Controllers 26 which, in exemplary eight missile canister module, includes 8 hatches. Launcher Bus 10 is connected to Module Interface Processors (MIP) 28. Finally, Embedded Launcher Processor (ELP) 30 is hooked to Launcher Bus 10 and Weapon Integration & Control (WI & C) Bus 32.

Figure 2:
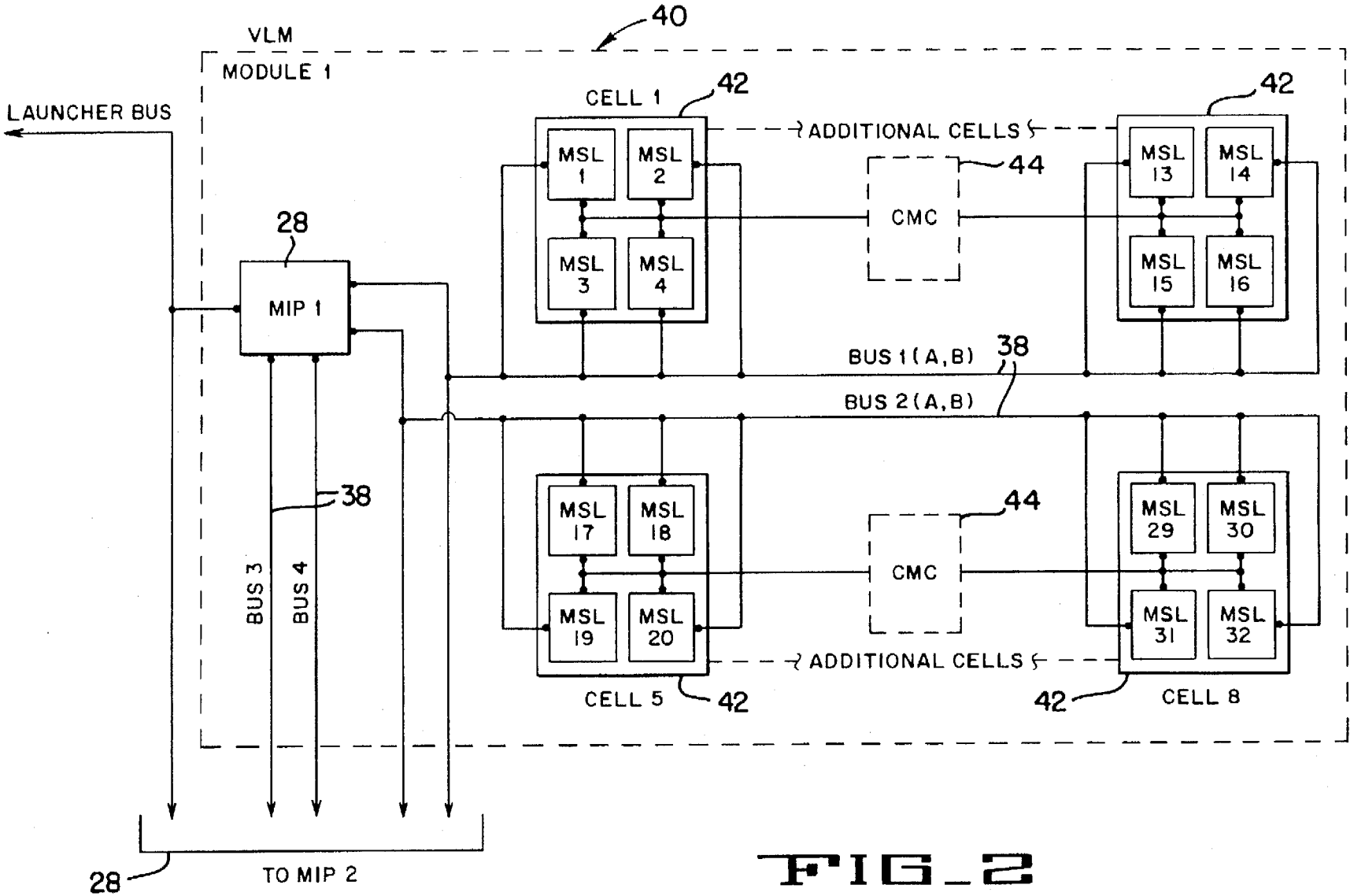
FIG. 2 is a block diagram of the control system connections to the missiles from FIG. 1.

FIG. 2 shows typical data and control interface to the canisters. MIP 28 is linked to Launcher Bus 10. MIP 28 is also hooked to a plurality of BUS 38. Each Bus 38 comprises Busses A and B as shown. MIP 28 is also connected to another bank of MIP 28 via a plurality of Bus 38. Vertical Launch Module (VLM) 40 includes Cell 42 which are connected to Bus 38. Each Cell 42 has a Cell Monitor Card (CMC) 44 which also connects to Bus 38. Although Vertical Launch Module (VLM) 40 comprises eight sets of cells, as indicated by the broken lines, additional cells may be added as required. This flexibility to handle additional cells, and in the alternate to reduce the number of cells, is one of the unique aspects of the present invention.

Figure 3:
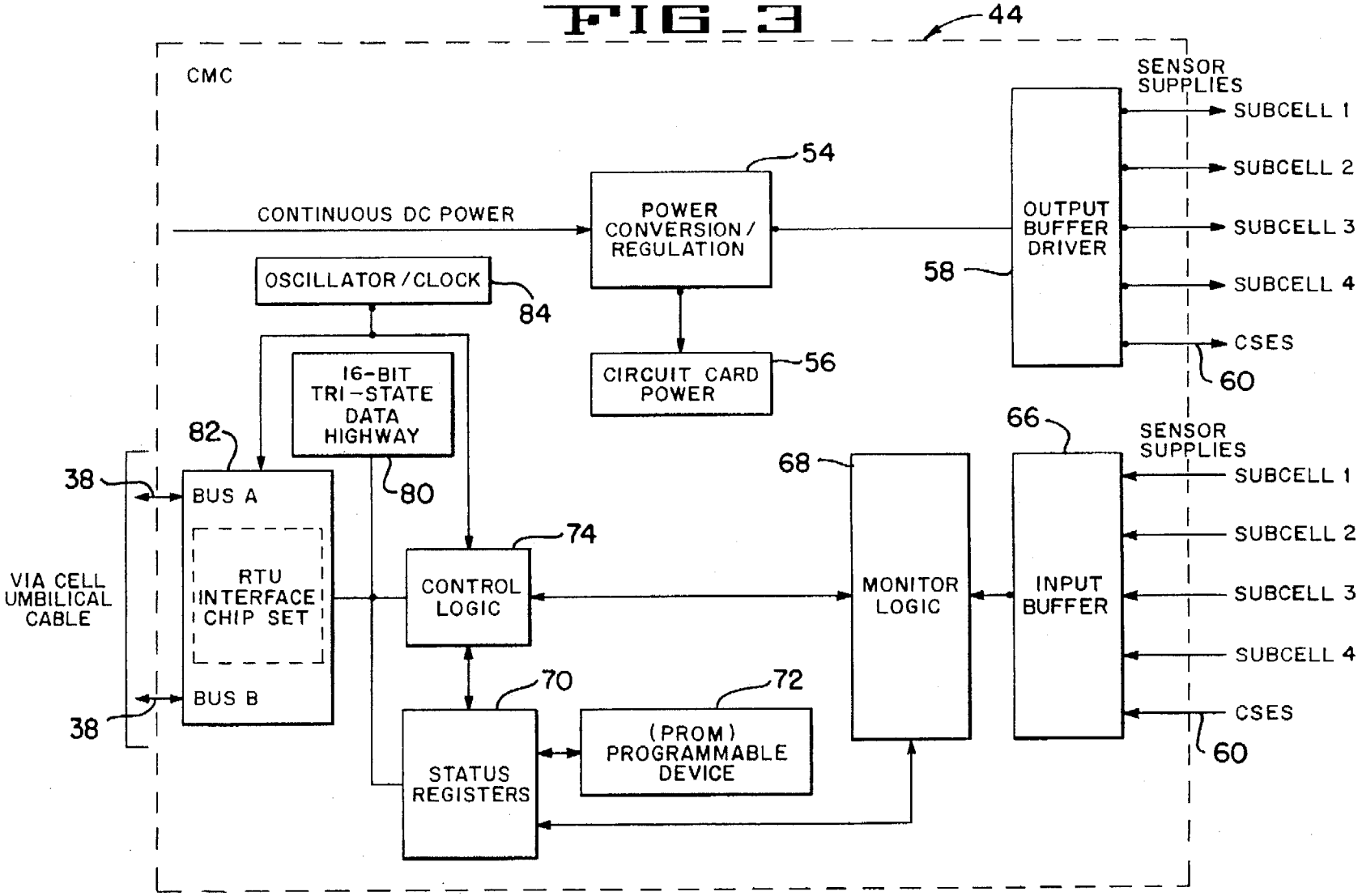
FIG. 3 is a block diagram depicting a cell status monitor showing output and input connections.

FIG. 3 is a detailed block diagram of the cell status monitor function of the CMC 44. Power is directed into Power conversion/regulation 54. Power conversion/regulation 54 is hooked to Circuit Card Power 56 and output Buffer/driver 58. Output Buffer 58 comprises sensor supplies to subcells of cell 42. Output Buffer/Driver 58 is also connected to Canister Safe and Enable Switch (CSES) 60. Similarly, input Buffer 66 is connected to sensor monitors from subcells of cell 42. Monitor logic 68 is connected to Status Register 70. Status Register 70 provides three connections with Programmable Device (e.g. Prom) 72, Control Logic 74, and 16-BIT Tri-State Data Highway 80. 16-BIT Tri-State 80 is further hooked to Control Logic 74 and Remote Terminal Unit (RTU) Interface Chip Set (or bus interface) 82 which provides connections to Bus 38 (comprising Busses A and B) via cell umbilical cable. Oscillator Clock 84 provides timing signals to Interface Chip Set 82 and Control Logic 74.

Figure 4:
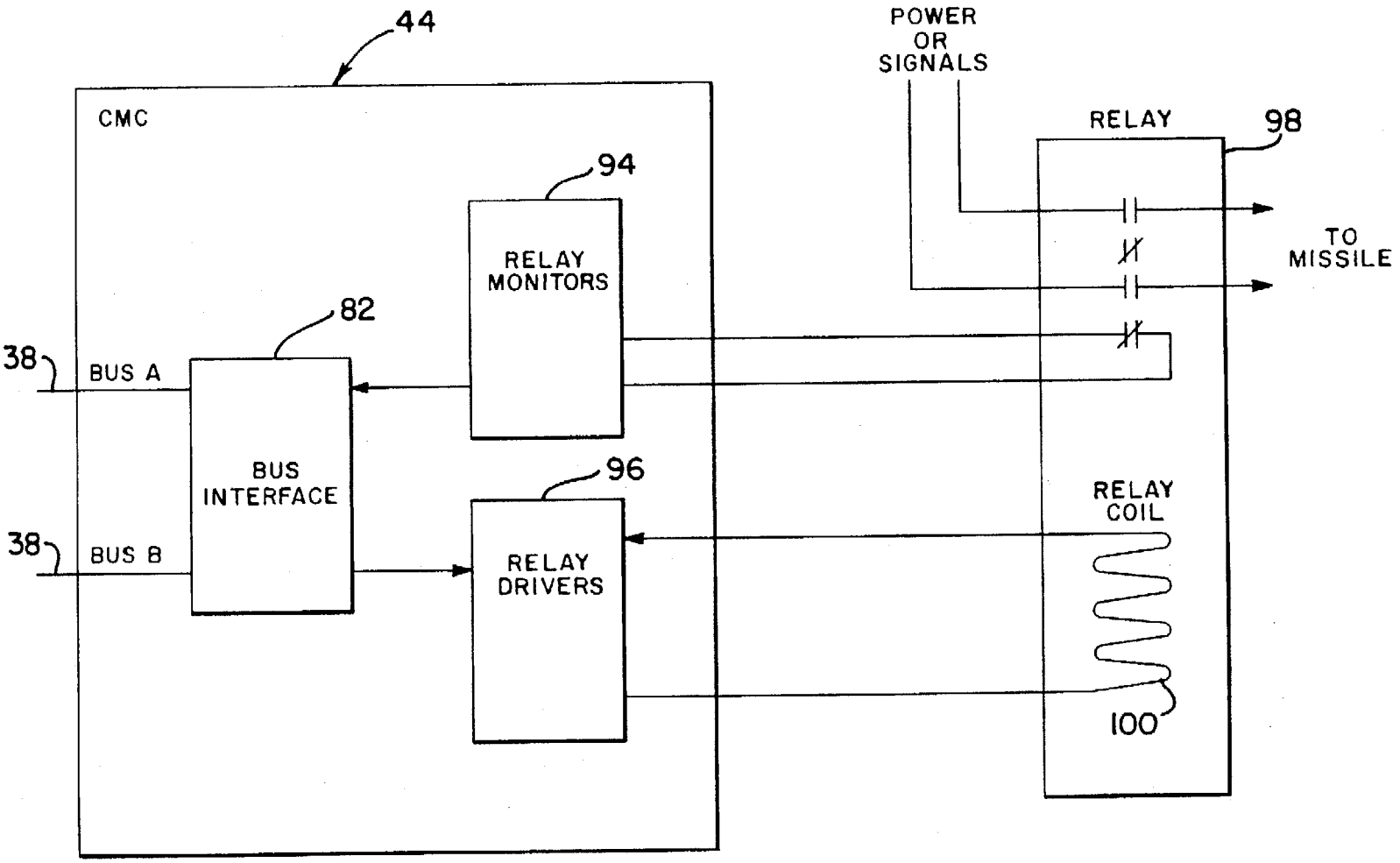
FIG. 4 is a block diagram of the Cell Monitor Card (CMC) which provides a relay status monitoring for the missile launch system.

FIG. 4 shows a detail of the connections of Cell Monitor Card (CMC) 44 relay status monitoring system. CMC 44 includes Bus interface 82 which provides contact with Bus 38. Further CMC 44 includes relay monitors 94 and relay drivers 96, which are both connected to Bus Interface 82. Further, relay monitors 94 are linked to relay 98. Similarly, relay drivers 96 are linked to relay coil 100.

Figure 5:
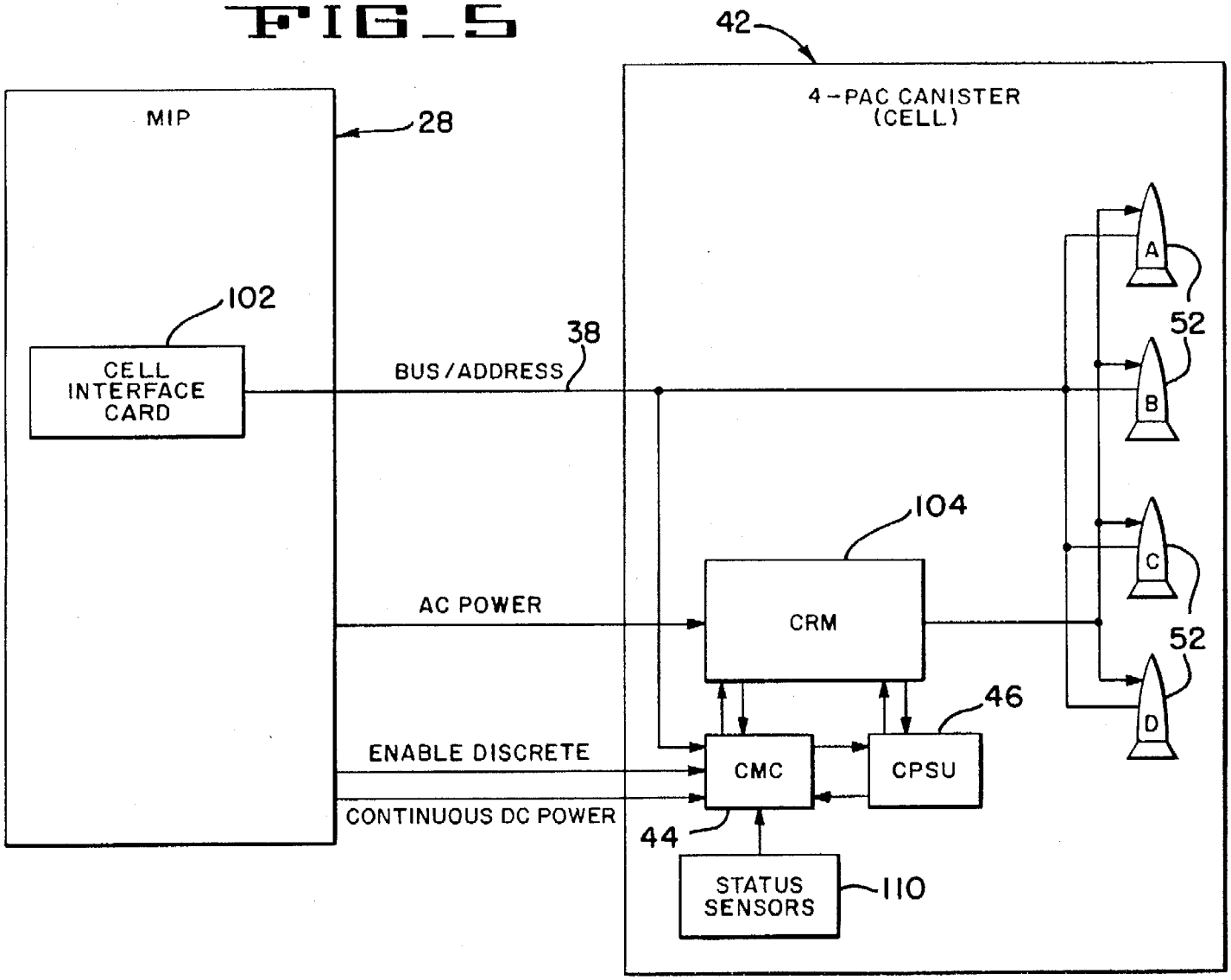
FIG. 5 is a block diagram of a typical 4-PAC™ (a smart canister designed to store and launch four missiles) control system showing interface connections within the canister and between the canister and a Module Interface Processor (MIP).

FIG. 5 is a typical block diagram of a 4-PAC™ canister which is equivalent to cell 42. Module Interface Processor (MIP) 28 provides connectivity through Cell Interface Card 102 to Missiles 52 and CMC 44 via Bus 38. Canister Relay Module (CRM) 104 is hooked to an AC power line and has a two way connection with Canister Power Supply (CPSU) 46. CPSU 46 is hooked to CMC 44. CMC 44 is supplied with continuous DC power and is also connected to Bus 38. Status Sensors 110 are also connected to CMC 44.

Figure 6:
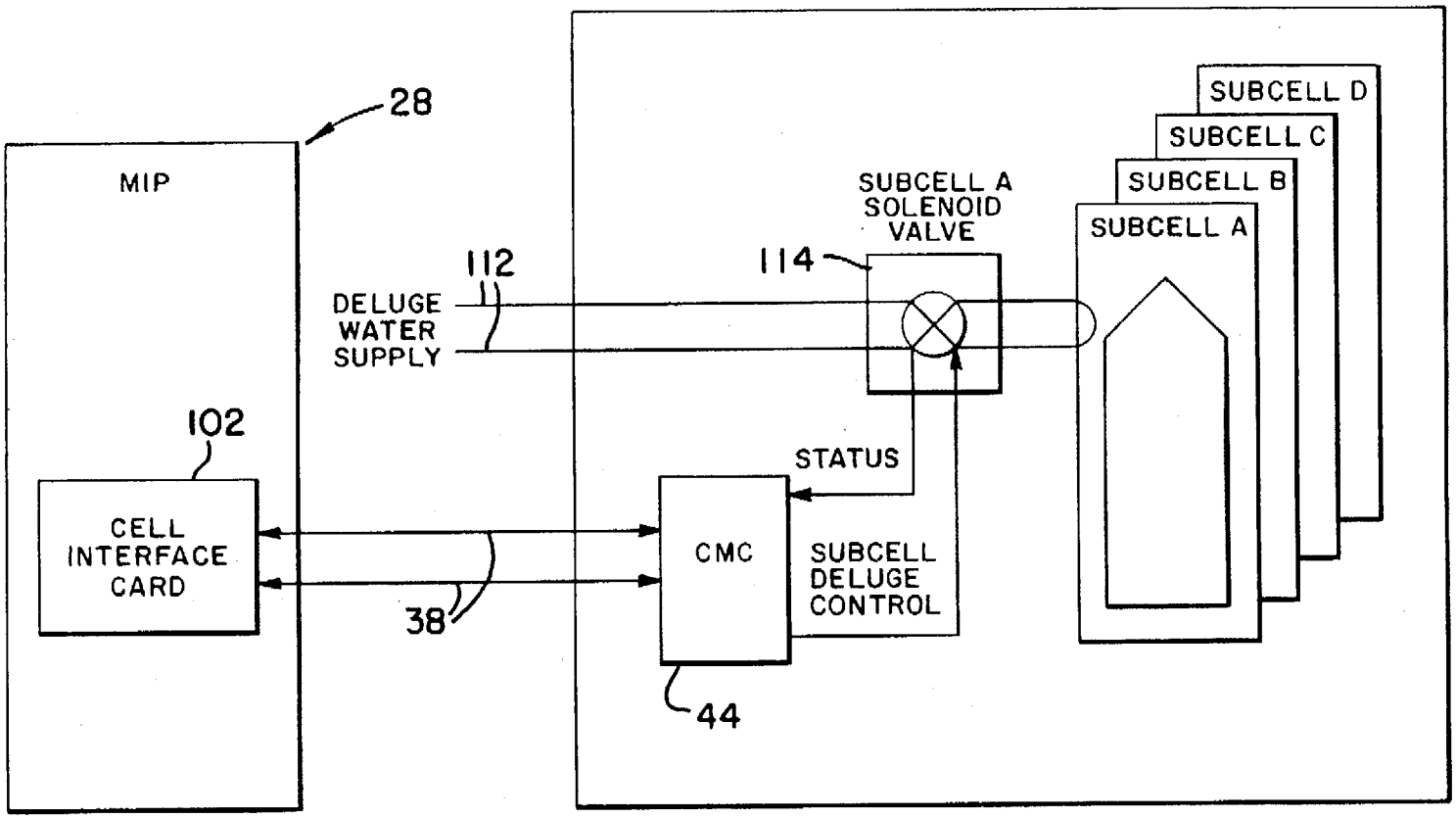
FIG. 6 is a block diagram of a typical 4-PAC™ subcell deluge control system.

FIG. 6 is a representation of a 4-PAC™ deluge control system. Deluge Supply 112 to subcell A is controlled by Solenoid Valve 114. Cell Monitor Card (CMC) 44 is linked to Solenoid valve 114. CMC 44 also provides connections with Cell Interface Card 102 in MIP 28 via Bus 38.

Figure 7:
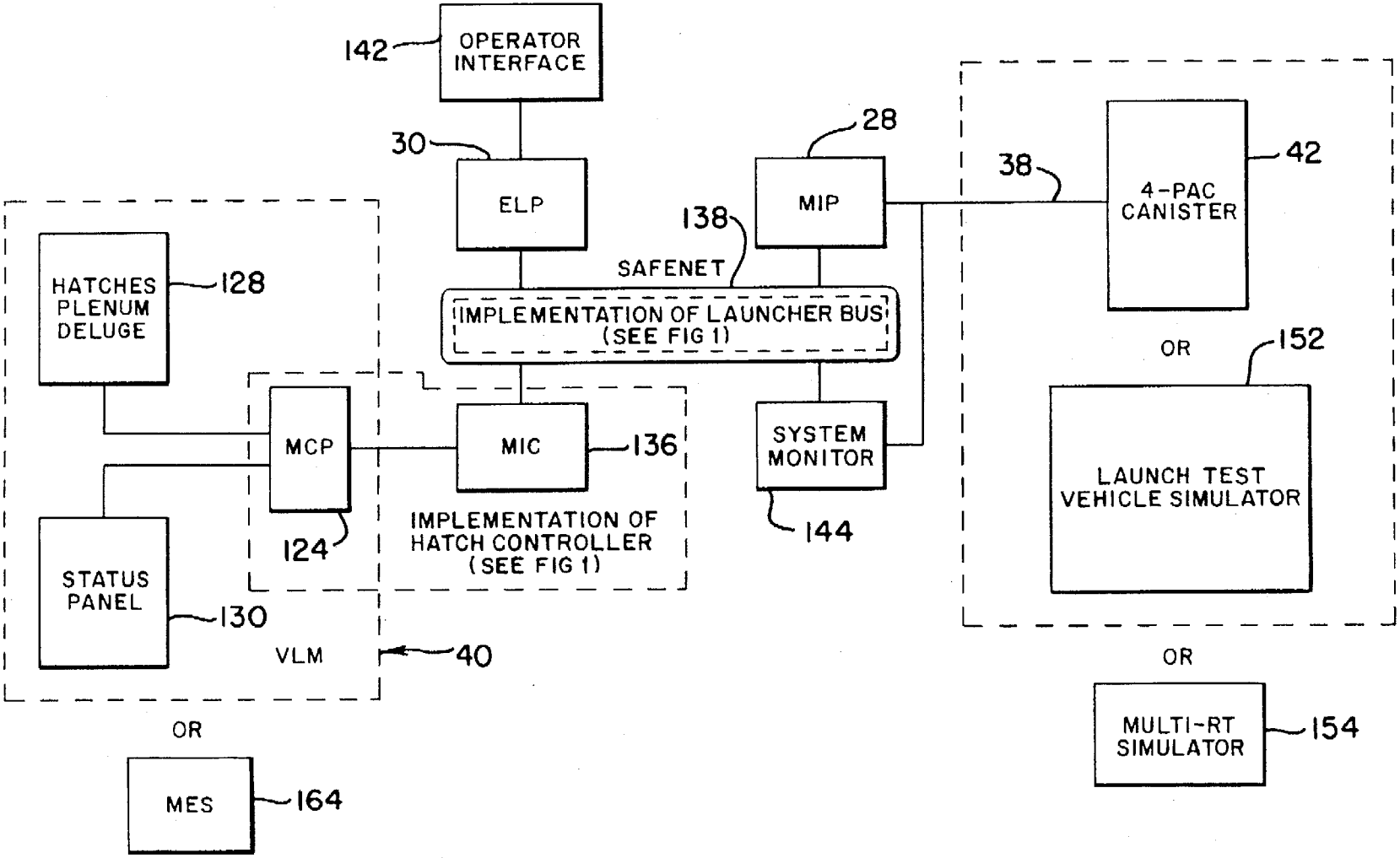
FIG. 7 is a block diagram of a launch control system showing connections and interactions of major system components.

FIG. 7 is a block diagram representation of the Launch Control System. The system comprises a Vertical Launch System module 40 which includes Hatches, deluge and plenum 128, and Status Panel 130. Both Plenum 128 and status panel 130 are hooked to Motor Control Panel (MCP) 124. Further, Motor Control Panel 124 is hooked to Motor Control Panel Interface Controller (MIC) 136. Interface Controller 136 is linked to Survivable Adaptable Fiber Optic Embedded Network (SAFENET) 138, which is a particular implementation of Launcher Bus 10. SAFENET 138 is linked to Embedded Launcher Processor (ELP) 30. Operator interface 142 is connected to ELP 30. SAFENET 138 is also linked to Module Interface Processor (MIP) 28 and System Monitor 144. MIP 28 and System Monitor 144 are joined to a 4-PAC™, canister 150 which is similar to cell 42, via Bus 38. In the alternate, MIP 28 and System Monitor 144 may be connected to launch test vehicle simulator 152 or Multi remote terminal (MULTI-RT) Simulator 154.

Figure 8:
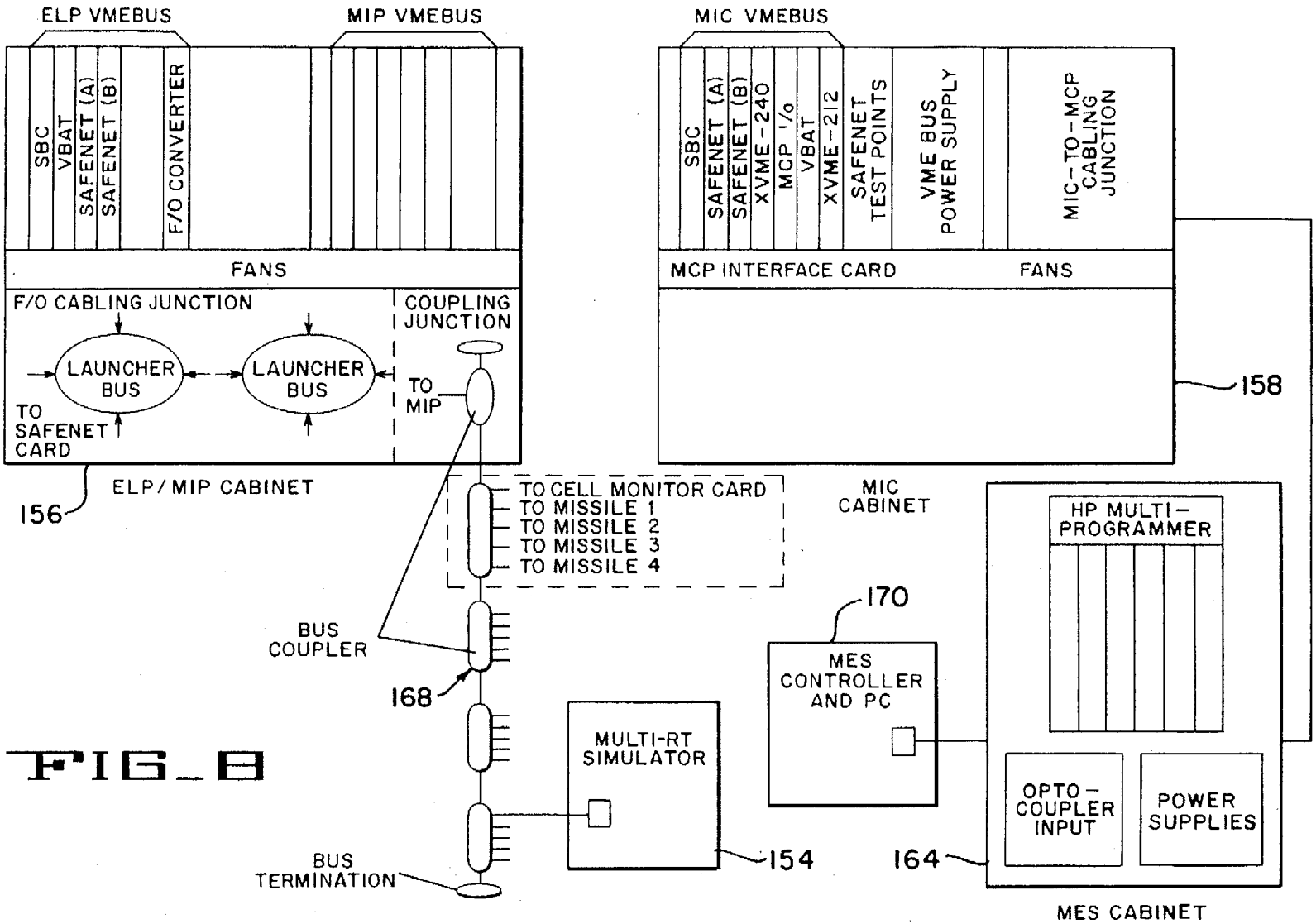
FIG. 8 is a block diagram showing a physical configuration of a launch control system demonstrator.

FIG. 8 is a Launch Control System Demonstrator Physical Configuration. Some of the significant components include Embedded Launcher Processor (ELP)/Module Interface Processor (MIP) cabinet 156; Motor Control Panel Interface Controller (MIC) cabinet 158; and Module Equipment Simulator (MES) cabinet 164. ELP/MIP cabinet 156 is coupled to Multi-RT Simulator 154 via coupler 168. MIC cabinet 158 is hooked to Module Equipment Simulator (MES) cabinet 164. Module Equipment Simulator (MES) Controller and Computer (PC) 170 are hooked to MES cabinet 164.

The disclosure hereinabove relates to some of the most important features and system hookup of the present invention. The operation and cooperative function of the system under a best mode consideration is described hereinbelow.

Generally, the present invention may be envisioned as a means to enhance the adaptability, flexibility and availability of conventional missile launching systems. In this context, the present invention could be construed as an addition to a conventional launch control system. A communications interface including multiplexing and demultiplexing functions provides a bridge between conventional launch control systems and Smart Canister Systems. The present invention can incorporate a reversible phase of preparation and an irreversible phase of preparation.

Referring to FIG. 1, and considering a reversible phase of preparation, i.e., the launch command may be aborted at any stage, launcher Bus 10 provides a communication network through which several cooperative controls are joined together and multiplexed. Eventually, these messages are demultiplexed and routed to different elements of the launch system to complete the launch. The smart canister systems' operation is initiated when Weapon Control System (WCS) 18 executes an engage command. The engage command is routed to ELP 30, which initiates the alert phase and specific engagement operatives such as the number of missiles to be readied, the rate and sequence of deployment, etc. Subsequent messages are routed to missiles 52 (See FIG. 5). Data Converters 12 and 14 are linked to Launcher Bus 10. Primarily Data Converters 12 and 14 change Data from one protocol and format to another and are used when the present invention is integrated to an existing missile control system. However, in modern missile control systems, which are contemplated by the present invention, WCS 18 is directly connected to ELP 30 via Bus 32. Accordingly, depending upon where the WCS 18 interface is available, connections could be made via Bus 10 and Data Converters 12 and 14, or WIC 32.

Embedded Launcher Processor (ELP) 30 primarily manages the missile launch. Module Interface Processor (MIP) 28 executes commands such as selection of a particular missile among a group stored in a module and communicates to missiles 52 via Bus 38. The present invention comprises a parallel MIP 28 which is a redundant system. This configuration enables bypassing one MIP 28 to use the available other. MIP 28 initiates the reversible module preparation phase. After the initiation phase, Hatch Controller 26 opens the hatch and confirms the command via Bus 10.

Referring now to FIGS. 2 and 5, MIP 28 command is directed to cell 42 where power connection to any number of missiles in Canister 42 are made via CMC 44, Canister Relay Monitor (CRM) 104 and Canister Power Supply (CPSU) 46. Hatch Controller 26 operates canister covers to allow missile flyout. Hatch Controller 26 remains open when a command to fire a missile is eminent. Further, cell monitor status is collected in cell 42 and transformed to digital Data via Busses (A and B) 38. Power function, and data coupled with the digital data comprise reversible functions, which unless terminated or otherwise reversed, prepare one or missile(s) 52. This status of missile(s) 52 is communicated to cell 42 wherein it is registered in cell status as monitored by CMC 44. The latest status is communicated to MIP 28 to confirm completion of reversible module preparation for launch via Bus 38. Similarly, the hatch open status from hatch Controller 26 is routed to MIP 28 where the reversible status is confirmed. MIP 28 status confirmation is routed to ELP 30 (See FIG. 1) via Bus 10. Hence, MIP 28 provides an interface between Launcher Bus 10 and missiles in cell 42. It should be noted that ELP 30 is a programmable processor which provides information storage for engagement command, sensor, actuator controls and interface. Particularly, ELP 30 is a bridge between Launcher Bus 10 and WIC Bus 32. Specifically, engagement command, status report, missile system control and related information are communicated between MIP 28 and ELP 30 via Launcher Bus 10. The output from ELP 30 is directed to WCS 18 where the reversible phase completion is confirmed. As discussed hereinabove, depending upon where the WCS 18 interface is available and the type of missile system being integrated, ELP 30 missile launch message is routed to WCS 18 via Bus 10, Data Converters 12 and 14 or WIC Bus 32 (See FIG. 1).

The same architecture can be used in an irreversible phase of preparation. Such a phase occurs when, for example, a missile has undergone a permanent change such as battery activation, arming etc. Under this scenario, the missile is either launched or dudded. Referring now to FIGS. 1, 2 and 5, the smart canister systems' operation is initiated when WCS 18 executes an engage command for at least one or numerous missiles. The engage command is confirmed via Bus 10, Data Converters 12 and 24 or WIC Bus 32. Further, the engage command is routed to ELP 30 where missile launch is managed and coordinated. ELP 30 routes missile launch information to MIP 28, via Bus 10, wherein launch authorization of the selected number of missiles is confirmed and the irreversible module preparation is completed. MIP 28 directs the confirmation message to cell 42 via Bus 38 and consequently battery activation and arming orders are executed. The application of power within the 4-PAC is controlled by CMC 44, CRM 104 and CPSU 46. Once the battery activate, arm etc., commands are completed missile (s) 52 enter into an irreversible stage wherein, as discussed hereinabove, missile launch is mandated or the missile(s) becomes a dud. Thereafter, CMC 44 and status sensors 110 provide canister status in cell 42. The canister status is then reported, via Bus 38, to MIP 28 where a monitor status resides. The monitor status from MIP 28 and navigation Data from INS 16 and 24 are entered into an initialization computer station in the ELP 30 via Bus 10 or Data Converters 12 and 14. The initialization computer information is transmitted by MIP 28 to missile(s) 52 via Bus 38 and missile(s) 52 are initialized. Once more, canister status is monitored in cell 42 by CMC 44. The status is reported to MIP 28 where the readiness of the module is monitored. Further the status of the hatch is provided by Hatch Controller 26 and also routed to MIP 28 via Bus 10. MIP 28 prompts ignition command which is directed to cell 42. As discussed hereinabove, the application of power and signals with the 4-PAC is monitored and operated by CMC 44, CRM 104 and CPSU 46. Henceforth, ignition signal is sent from cell 42 to missile(s) 52. CMC 44 and Status Sensors 110 determine canister status which is reported to MIP 28 via Bus 48. The status report includes a missile away report to sense and confirm deployment and launch of missile(s) 52. MIP 28 monitors missile flyaway and routes the information to ELP 30 via Bus 10. ELP 30 detects missile away and directs the message to WCS 18 via Bus 10 and Data Converters 12 and 24 or WIC Bus 32 thereby completing the irreversible phase of preparation.

FIGS. 3 and 4 provide details of CMC 44. These two diagrams provide details of the cooperative structures and hardware associated with cell 42. In the interest of clarity, cell 42 involving reversible and irreversible preparations will be discussed.

First, considering a reversible phase in cell 42 and referring to FIG. 5, CMC 44 is supplied with functional data from several sources. Canister power supply status is communicated to CMC 44 by CPSU 46. Relay status is reported by CRM 104 and hazard and status signals are reported by sensors 110. Further, CMC 44 incorporates subcell status monitors (Refer to FIG. 3) such as output buffer driver 58, input buffer 66, monitor logic 68, status registers 70, control logic 74, 16-BIT data highway 80 and relay monitors 94 (see FIG. 4). From these inputs and interactions, CMC 44 determines canister status. CPSU 46 and CRM 104 are energized and MIP 28 engaged via Bus 38 to provide missile preparation command. Remote Terminal Unit (RTU) interface chipset 82, which provides connections to Bus 38 (consisting of Busses A & B, See FIG. 3), and relay drivers 96 (See FIG. 4) cooperate to energize CPSU 46 and CRM 104. Further CMC 44 interacts with CPSU 46 to activate reversible phase power. CMC 44 also interacts with CRM 104 to energize subcell relays. The subcell relays are controlled by relay 98 and relay coil 100 (See FIG. 4). The energize subcell relays command causes CRM 104 to activate the reversible phase power, system function and other missile preparation commands. Status sensors 110 provide hazard and status monitoring data to CMC 44. Similarly, CPSU 46 and CRM 104 provide status and relay status, respectively to CMC 44 via relay monitors 94. The status of missile(s) 52 is also directly entered into CMC 44. All these inputs enable CMC 44 to monitor and determine the most current canister status. The latest and final status is reported to MIP 28 from CMC 44 via Bus 38. Accordingly, the reversible activation of missiles is entered into CMC 44 and the final status report routed through CMC 44 to complete the reversible cycle.

The irreversible phase involving canister 42 differs from the reversible phase in only a few steps. Primarily, canister status is monitored and determined in CMC 44 with the attendant inputs from status sensors. Further, MIP 28 provides the activation of batteries, arming and other launch commands to CMC 44 via Bus 38. CPSU 46 activates the irreversible phase power. CRM 104 energizes subcell relays in the same manner as discussed hereinabove. Both the outputs from CPSU 46 and CRM 104 are routed to missiles 52 to activate missile release and also execute battery activation, arm and other launch commands. The missile release is controlled by actuators which provide restraint status data to CMC 44. Additionally status is directed to CMC 44 from missiles 52, actuators, sensors 110, CRM 104 and CPSU 46. Eventually CMC 44 monitors and determines the latest canister status from these inputs. This final status report, including missile away, is routed to MIP 28 via Bus 38, thus completing the irreversible cycle.

Turning now to FIG. 6, a subcell deluge control is shown for a 4-PAC module. The deluge system is one of the hazard control and management systems which is triggered by monitors 68 (See FIG. 3) in CMC 44, based on a predetermined temperature threshold among other factors. Unplanned ignition or defective ignition may be controlled by the deluge system. Further, if the missile is fired in a restrained mode such that flyout is restricted due to system malfunction or a planned restrained firing, a deluge system would provide a safe control of the consequential hazards. Accordingly, the present invention includes a deluge water supply 112 which is controlled by a solenoid valve 114. As discussed hereinabove MIP 28 through RTU 82 is joined by a two-way link to CMC 44. Solenoid valve 114 is connected to CMC 44 by a two-way link. The first link provides input as to the status of solenoid valve 114. On the output side, CMC 44 initiates a subcell deluge control. Accordingly, if a deluge is to be discharged on missile 52 CMC 44 status monitors open solenoid valve 114. When the hazard is no longer present status sensors 110 indicate same and solenoid valve 114 is closed.

One of the important aspects of the present invention includes the Launch Control System which is depicted in FIG. 7. Exemplary Vertical Launch Control Module 40 is shown connected to Motor Control Panel Interface Controller (MIC) 136. Vertical Launch Control module 40 comprises Hatch-Plenum-deluge (HPD) 128, Status panel 130 and MCP panel 124. Further, status panel 130 and HPD 128 are hooked to MCP 124. During a launch a motor operates the hatches to allow missile flyout. Plenum functions are activated to vent exhaust gases and plume away from adjacent canisters to prevent damage to stored missiles. In case of hazard conditions, deluge supply 112 is activated to discharge water on the warhead or missile. MIC 136 is hooked to SAFENET 138. SAFENET 138 provides contact with Embedded Launcher Processor (ELP) 30. Operator Interface 142 is hooked to ELP 30. Furthermore, SAFENET 138 is connected to MIP 28 and system monitor 144. An umbilical connection joins 4-PAC™ canister, similar to cell 42, with MIP 28 and system monitor 144. Since SAFENET 138 is a fiber optic embedded network which is otherwise incompatible with MCP 124 hardware, MIC 136 is used as an interface controller for MCP 124 and SAFENET 138 and forms a shared boundary between the two units. The fire command is initiated by an operator at the operator interface 142, representing a simulation of WCS 18. Embedded Launcher Processor (ELP) 30 accepts the operator's command and routes it through SAFENET 138 to motor control panel interface controller (MIC) 136. Here the command is decoded and directed to MCP 124 which controls the motors for activating the hatch, plenum and exhaust management hardware and the deluge system. Furthermore, the command is communicated to MIP 28 and system monitor 144 via umbilical connection to a 4-PAC™ canister, which is similar to cell 42, to initiate ignition and execute missile launch. VLS module 126 may be replaced by Module Equipment Simulator (MES) 164. Similarly, the 4-PAC™ canister may be replaced by a Launch Test Vehicle Simulator 152 or Multi-Remote Terminal Simulator 154.

As discussed hereinabove, a Launch Control System Demonstrator physical configuration is shown in FIG. 8. Essentially the system is a small scale representation of the Smart canister System discussed in this disclosure. Primarily, this architecture depicts a demonstrator unit which is used to validate and prove the concepts of the present invention.

Accordingly, the present invention provides embedded processors, interface controllers, local area network, built-in-test, redundant bi-directional busses, electronics which perform analog/digital signal multiplexing/demultiplexing functions, collection and transmission of canister sensor information, control of canister functions, and Data conversion/storage for interacting with missiles. The Smart Canister Systems of the present invention is highly adaptable to existing systems. Implementation of the present invention in a system such as a Vertical Launching System (VLS), for example, involves integrating Cell Monitor Card (CMC) 44 to perform a multiplexing canister status information over dual redundant data busses. Similarly, the present invention may be integrated in part or in whole to enhance the features of a conventional missile launching system. The present invention may be segmented to provide needed capabilities to a launch system. For example, a multi-missile canister may be upgraded to include hazard assessment and damage control system by annexing to it the fire control and deluge modules of the present invention.

While a preferred embodiment of the smart canister systems has been shown and described, it will be appreciated that various changes and modifications may be made therein without departing from the spirit of the invention as defined by the scope of the appended claims.

What is claimed is:

1. A smart canister system to provide a faster response time for firing missiles and enable higher launcher possibility in a multifarious missile environment, the system comprising:

an operator interface to initiate a weapon control system;

said operator interface being linked to at least one embedded launcher processor wherein said embedded launcher processor manages a missile launch in cooperation with said weapon control system;

a launcher bus for carrying information on engagement command, status report, missile system control and related information connected to said at least one embedded launcher processor and further connected to a module interface processor, a system monitor and a hatch controller wherein said module interface processor executes commands including selection of a particular missile among a group of missiles stored in a canister, said system monitor for use in monitoring said group of missiles stored in said canister, and said hatch controller for use in operating covers of said canister to allow missile flyout;

said module interface processor connected to a missile cell via a bus;

said system monitor linked to said bus and thereby connected to said missile cell;

said hatch controller connected to a vertical launch module control; and said operator interface, said launcher bus, said module interface processor, said system monitor and said hatch controller being in communication with said weapon control system.

2. The smart canister system of claim 1 wherein said launcher bus includes connections to a plurality of data converters wherein said data converters change data from one protocol and format to another and provide links with forward and aft inertial navigation systems for missiles wherein said inertial navigation systems for missiles control direction of missile flight and provide links with said weapon control system to integrate the smart canister system with another missile control system.

3. The smart canister system of claim 1 wherein said hatch controller includes a motor control to operate said hatch in cooperation with said weapon control system.

4. The smart canister of claim 1 wherein said missile cell and said bus are connected to at least one cell monitor.

5. The smart canister system of claim 1 wherein said vertical launch module control includes a hatch-plenum-deluge panel, forming a hazard and interface control system, having direct links to a motor control panel in said hatch controller.

6. A smart canister system for managing the firing of missiles from canisters, the system comprising:

an operator interface to initiate a weapon control system;

said operator interface being linked to at least one embedded launcher processor wherein said embedded launcher processor manages a missile launch in cooperation with said weapon control system and further connected to a module interface processor wherein said module interface processor executes commands including selection of a particular missile among a group of missiles stored in a canister, furthermore said operator interface being connected to a system monitor and a hatch controller wherein said system monitor monitors said group of missiles stored in said canister and said hatch controller controls operations of canister covers to allow missile flyout;

said module interface processor connected to a launch test vehicle simulator via a bus wherein said launch test vehicle simulator enables simulation of actual missile launch from a vehicle on which a missile launcher comprising said canisters is mounted;

said system monitor linked to said bus and thereby connected to said launch test vehicle simulator; and said hatch controller connected to a module equipment simulator wherein said module equipment simulator includes a simulation model of a launcher for a vertical launching system (VLS).

7. The smart canister system of claim 6 wherein said launch test vehicle simulator includes built-in-test and diagnosis for a missile cell to thereby enable testing of launch controls and missile firing systems for said missile cell.

8. The smart canister system of claim 6 wherein said module equipment simulator includes built-in-test and diagnosis for a vertical launch module to thereby enable testing of launch and missile fire control systems for said vertical launch module.

* * * * *